US006759088B2

(12) United States Patent
Prosser

(10) Patent No.: US 6,759,088 B2
(45) **Date of Patent: *Jul. 6, 2004**

(54) DECORATIVE METHOD USING A BLANK FOR A DECORATOR'S TOOL

(76) Inventor: Edward C. Prosser, The Boughs, Caemawr Road, Porth, Mid Glamorgan (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/266,400

(22) Filed: Oct. 7, 2002

(65) Prior Publication Data

US 2003/0031796 A1 Feb. 13, 2003

Related U.S. Application Data

(63) Continuation of application No. 09/656,460, filed on Sep. 6, 2000, now Pat. No. 6,465,072, which is a continuation of application No. 09/245,695, filed on Feb. 6, 1999, now abandoned, which is a continuation of application No. 08/932,085, filed on Sep. 17, 1997, now Pat. No. 5,869,137, which is a continuation-in-part of application No. 08/793,827, filed as application No. PCT/GB95/02018 on Aug. 24, 1995, now Pat. No. 5,876,828, and a continuation-in-part of application No. 08/481,384, filed as application No. PCT/GB94/00136 on Jan. 24, 1994, now abandoned.

(30) Foreign Application Priority Data

Jan. 25, 1993 (GB) ..... 9301394
Aug. 25, 1994 (GB) ..... 9417186

(51) Int. Cl.[7] ..... B05D 1/40; B05D 7/06

(52) U.S. Cl. ..... 427/256; 427/271; 427/274; 427/277

(58) Field of Search ..... 427/256, 271, 427/274, 277, 267, 270, 355, 408; 15/210.5

(56) References Cited

U.S. PATENT DOCUMENTS

| | | | | |
|---|---|---|---|---|
| 605,244 | A | | 6/1898 | Callow |
| 619,298 | A | * | 2/1899 | Gochnaur |
| 960,821 | A | | 6/1910 | Clapp |
| 2,877,588 | A | | 3/1959 | Ernst |
| 3,692,557 | A | | 9/1972 | Sormani |
| 3,816,155 | A | * | 6/1974 | Iverson et al. |
| 3,843,992 | A | | 10/1974 | Briggs |
| 3,904,791 | A | | 9/1975 | Iverson et al. |
| 4,921,891 | A | | 5/1990 | Cope |
| 5,507,064 | A | | 4/1996 | King |
| 5,869,137 | A | * | 2/1999 | Prosser |

FOREIGN PATENT DOCUMENTS

| | | |
|---|---|---|
| DE | 375218 | 10/1920 |
| DE | 93 13 771 U1 | 12/1993 |
| EP | 0406514 A2 | 1/1991 |
| FR | 2599412 A1 | 12/1987 |
| GB | 453253 | 9/1936 |
| WO | WO 94/16910 A1 | 8/1994 |
| WO | WO 96/05971 A1 | 2/1996 |

* cited by examiner

*Primary Examiner*—Fred J. Parker
(74) *Attorney, Agent, or Firm*—Edwin D. Schindler

(57) ABSTRACT

A method of providing a substrate with a decorative coating simulating the appearance of grained wood. A continuous layer comprising an aqueous medium which contains a polymeric binder and a particulate, non film-forming material is applied to an opaque surface of the substrate (the particulate material and the resulting layer both being lighter in color than the opaque surface. While the layer remains in the liquid state, a tool having a longitudinal extending face which has a convex section transverse to the longitudinal direction thereof, is drawn along the layer, the face of the tool having a series of spaced ridges along the longitudinal direction. The tool is rocked about the face as the tool is drawn along the layer, so as to discontinuously remove parts of the layer and selectively expose part of the underlying surface and to produce a decorative appearance resembling heart grains of cut timber.

4 Claims, 6 Drawing Sheets

DECORATIVE METHOD USING A BLANK FOR A DECORATOR'S TOOL

This is continuation of application Ser. No. 09/656,460, filed Sep. 6, 2000, now U.S. Pat. No. 6,465,072, which is a continuation of application Ser. No. 09/245,695, filed Feb. 6, 1999, now abandoned, which is a continuation of application Ser. No. 08/932,085, filed Sep. 17, 1997, now U.S. Pat. No. 5,869,137, which is a continuation-in-part of both application Ser. No. 08/481,384, filed Sep. 15, 1995, which is the U.S. National Phase application of P.C.T. Application No. PCT/GB94/00136, filed Jan. 24, 1994, now abandoned; and, of application Ser. No. 08/793,827, filed Mar. 10, 1997, which is the U.S. National Phase application of P.C.T. Application No. PCT/GB95/02018, filed Aug. 24, 1995, now U.S. Pat. No. 5,876,828.

BACKGROUND TO THE INVENTION

The present invention is concerned with a decorative method and a blank for a decorator's tool and in particular a decorative method for providing a grained appearance on a substrate.

Grain imitation techniques are known in which a scumble glaze is applied to a painted wood substrate, the scumble glaze being applied in a streaky discontinuous manner to give the appearance of natural graining. Currently used techniques however are very time consuming and require considerable expertise, such as that of a craftsman, to create a desired natural grain appearance. They do not therefore appeal to amateur (that is, "do-it-yourself") painters, who represent an increasingly important part of the market.

Similarly, it is known to create imitation woodgrains on a surface using specialised tools to create the grain finish. Normally, at least two tools are required in order to achieve the desired effect. Existing tools consist of combs having teeth or the like which are used to establish a continuous streaked or grained appearance on a painted substrate, and a separate tool having a convex surface, with a series of concentric ridge formations on the convex surface, which can be used to selectively expose parts of the surface, so as to produce a simulated woodgrain appearance on the surface. Using separate tools to create the woodgrain finish suffers from a number of drawbacks. In addition, packaging of two separate tools in a box or the like requires extra packaging space and packaging material, which adds to the total cost of the product.

OBJECTS OF THE INVENTION

It is the primary object of the present invention to provide a method which will appeal to the amateur and alleviate some of the abovementioned problems.

It is a further object of the invention to provide a blank for a unitary, hand-holdable tool, suitable for use by both amateur and professional decorators in creating an imitation woodgrained finish on a surface.

SUMMARY OF THE INVENTION

According to a first aspect of the present invention, there is provided a method of providing a decorative coating for an opaque surface, which method comprises applying to said opaque surface a substantially continuous layer comprising an intimate mixture comprising a particulate (preferably non film-forming) material and an aqueous film-forming polymer binder, said particulate material and said layer both being lighter in color than said opaque surface, and discontinuously removing part of said layer (preferably in streaks) using a tool so as to selectively expose part of said opaque surface.

Any experienced professional or amateur painter will know, by judgement by eye and instinct, the difference between lighter and darker shades of color. However, if needed, guidance can be gained from the international system of color definition known as the Natural Color System ("NCS.") The NCS system is described in the "ICI Colour Dimensions Colour Atlas" published by Imperial Chemical Industries P1c of London in 1986 ("Colour Dimensions" is a trademark of Imperial Chemical Industries). The NCS system defines color in terms of a cypher, the first two digits of which extend from 00 to 99 with 00 representing white (that is, the ultimate lightness) and 99 representing black, and the intermediate values from 01 to 98 representing increasingly darker shades. Lighter shades therefore have a lower pair of first digits. It is preferred that the particular material and the continuous layer have an NCS value at least 10 units lower than that of the surface.

DESCRIPTION OF PREFERRED EMBODIMENTS

The particulate material is typically an inorganic material, which may be hydrated, such as plaster (gypsum), clay or the like, or non-hydrated, such as chalk or titanium dioxide. When an inorganic material is used, it is advantageous that the intimate mixture used in the method according to the invention may be fire retardant.

Alternatively, an organic particulate material, such as hollow or alveolate beads of polystyrene or the like, or finely chopped fibers may be used. Suitable organic beads are described, for example, in European Patent Specification No. 0,113,435 B1, published Jun. 7, 1989. This European Patent Specification describes an aqueous paint having an improved "hiding quality." The aqueous paint in the European reference consists essentially of pigmented vesiculated beads and opaque polymer particles in a ratio of 30/70 to 90/10, the proportion of opaque polymer particles being smaller at higher pigment volume concentrations. The particulate material is intimately mixed with the aqueous polymer binder, preferably together with thixotropising material, such as a polyurea adduct or bentonite clay, so as to provide thixotropic mixture.

It may be preferred that the intimate mixture further comprises reinforcing fibers which can serve to strengthen a resulting coating provided on the opaque surface.

Advantageously, the intimate mixture further comprises a drying retardant (a material which retards drying of the coating). The use of a drying retardant is beneficial in allowing the mixture to be applied as a substantially continuous layer and further allowing subsequent removal thereof before substantial drying of the layer has occurred.

A preferred drying retardant comprises a gel material. Examples of gels suitable for use as a drying retardant are cellulose-based products such as carboxymethyl cellulose, hydroxymethyl cellulose and methyl cellulose, acrylamide and acrylate polymers and copolymers, gelatin, polysaccharides, polyoxamers (polyoxyethylene-polyoxypropylene block copolymers), pectins and agar.

It is preferred that the aqueous polymer binder is translucent. Preferably the binder comprises an aqueous dispersion of particles of polymer which are capable of coalescing as the dispersion dries so as to form a film of polymeric material. Suitable polymers include polymers and copolymers of esters such as methyl, ethyl, propyl and hexyl esters of acrylic or methacrylic acids, optionally with acrylic or methacrylic acid or polymers, or copolymers of vinyl esters including vinyl acetate. Certain copolymers of these types are now available as aqueous solutions as opposed to dispersions.

The aqueous polymer binder may, in some cases, contain a minor proportion by weight of an organic solvent, which should be miscible with water. An example of such a solvent is an alcohol.

It is preferred that the intimate mixture comprises substantially equal amounts of an aqueous carrier, typically water, and the particulate material, the aqueous carrier and particulate material being present in excess of the polymer binder. A preferred intimate mixture comprises 4 to 6 parts by weight of the particulate material, 4 to 6 parts by weight of water optionally 0 to 2 parts organic (preferably alcoholic) co-solvent to assist film formation and 0.5 to 3 parts by weight of the aqueous polymer binder. In a particularly preferred embodiment of the present invention, wherein the intimate mixture further comprises a drying retardant substantially as hereinbefore described, the preferred intimate mixture includes 0.5 to 3 parts by weight of the drying retardant.

The opaque surface may be provided by wood, plastics, metal or the like, and it preferably has a darker color than the intimate mixture. In some embodiments it is preferred that the substrate comprises wood. The invention is particularly advantageous in enabling the production of an article having a grained appearance, such as that simulating limed oak, limed maple, limed ash or the like. The substrate may, for example, be timber, or a fiber board such as MDF (medium density fiber board).

Advantageously, the substrate comprises a building structure such as a wall panel, door, door frame, window frame, wainscotting or the like. Alternately the substrate may comprise a furniture component such as a fitted kitchen or bedroom unit, closet door, table, seat or the like. In some embodiments, the substrate comprises at least one generally planar surface which is required to have a grained appearance as described above.

It is preferred that the method involves applying an opaque protective or decorative coating to the substrate so as to provide the latter with a sufficiently dark opaque surface substantially as hereinbefore described. The opaque coating is preferably applied so as to substantially cover an exposed surface of the substrate. Preferably the opaque coating is water based, although organic solvent-based coatings may be employed.

It is further preferred that the method according to the invention involves applying a translucent or transparent coating (such as a varnish, which is preferably water-based), over the discontinuous decorative coating described above. The translucent or transparent coating (which may be lighter or darker than the previously mentioned decorative coating) may itself contain a stain material, pigment, dye or the like; alternately, a stain may be applied to the translucent or transparent coating.

The opaque surface typically comprises a paint selected to provide a surface of the substrate with a desired base color. A particularly preferred color of the opaque surface is brown or beige, which can contrast with the lighter color of the intimate mixture, and give the appearance of a naturally grained effect. Further preferred colors of the opaque surface include gray, or other background colors, such as blue, green, red, yellow or the like.

The particulate material preferably has a white, cream, beige or brown color which contrasts with the darker color of the opaque surface. Examples of suitable such colors are Y 00 R (usually written as "Y") up to Y 90 R according to the NCS definition referred to above. The particulate material may advantageously be mixed with colorants or the like to provide the intimate mixture with a desired color. The color combination of the opaque surface and the intimate mixture is advantageously selected to simulate a grained appearance of a desired wood effect.

The decorative coating may be applied by brushing, pad spreading, rolling or spraying onto the opaque surface. Advantageously the decorative coating is allowed to substantially dry (typically for at least one hour) before subsequent application of the intimate mixture thereon.

The intimate mixture is preferably similarly applied to the opaque surface by brushing, pad spreading, rolling or spraying thereon. The intimate mixture is preferably applied to provide a substantially continuous layer having a thickness (prior to drying) in the range of 0.3 to 2 mm. The thickness of the layer is selected to provide an appearance of a desired grain, a preferred thickness being about 0.5 mm.

It is preferred that removal of the continuous layer involves at least two stages. In the first stage, it is preferred that the continuous layer is discontinuously removed in non-linear streaks to give the opaque surface a veined, streaked or grained appearance, preferably using a comb member including a plurality of distal teeth, the comb member being drawn along the opaque surface to provide a veined appearance resembling that of woodgrain. Preferably the tips of the teeth each respectively comprise a contact edge extending for about 2 to 5 mm in the general direction of the comb member, the tips advantageously being spaced apart by about 2 to 10 mm.

Advantageously, in a second stage of the removal of the continuous layer, it is preferred that the veined, grained or streaked surface is treated with at least one tool member having a plurality of spaced apart proud formations (typically of plastics or elastomeric material or the like), to selectively expose parts of the opaque surface.

In a highly preferred embodiment, the tool member is a rockable tool, which preferably comprises a convex face, such that the tool can be rocked about the convex face, with a plurality of substantially concentric raised arc formations on the convex face.

A "rocking" action is, of course, quite different from a sliding or rolling action. When the tool is rocked, it is caused (generally by a cocking action of the user's wrist) to pivot, or partially rotate, through no more than 180 degrees, about an axis substantially parallel to the surface, as it is drawn across the surface, before being partially rotated in the opposite sense. This rocking is generally a reciprocal or oscillatory action, in which the tool is rocked to-and-fro in a manner similar to at least one oscillation of a see-saw. This rocking action is generally achieved manually by the user cocking his wrists as the tool is drawn across the surface.

As the tool is rocked, the proud formations of the tool are in contact with (and are drawn along) the layer on the substrate. The rockable tool is typically drawn along the opaque surface, advantageously in the general direction of the previously formed veined, grained or streaked appearance, so as to provide a knot or heart grain effect (sometimes known as crown grain effect) on the opaque surface. This knot or heart grain has been found to be especially aesthetically attractive, being a simulation of a cut lengthwise along the trunk of sawn timber (parallel or tangential to growth rings and simulating a cut through a knot region of cut timber).

It is further preferred that as the rockable tool is drawn along the opaque surface, the convex face thereof is rocked to and fro substantially in the direction of travel of the tool (that is, about an axis substantially transverse to the direction of travel).

According to a second aspect of the invention, there is, therefore provided a blank for forming a decorator's tool, which blank can be wrapped around and secured to itself by securing means to form said tool, such that said tool comprises at one end thereof a hollow body having a convex surface with a plurality of spaced-apart proud formations on the convex surface.

The proud formations on the convex surface may comprise a series of substantially concentric formations. Advantageously, the concentric formations comprise a series of alternating ridges and furrows concentric about a substantially intermediate point on the convex surface of the tool. The tool can be rocked about the convex surface to complete a simulated woodgrained finish created by the concentric ridges and furrows. Alternately, the proud formations may be more irregular, or may comprise a series of spaced ridges in the form of straight or wavy lines. It may be desirable to provide gaps in such lines at spaced intervals (that is, the lines may be discontinuous).

The tool is generally hollow, and is generally also resilient; this means that the user can vary the effect on the surface by varying the pressure applied while drawing and rocking the tool. This represents an operational advantage relative to a non-resilient tool. Preferably, a plurality of apertures are positioned within the alternating ridges and furrows on the convex surface of the tool. Thus, a build-up of excess woodgraining material within the furrows may be substantially alleviated as the material can pass into the interior of the tubular body of the tool, thus facilitating cleaning of the tool and collection of the excess material when such material has passed through the apertures on the convex surface, to the inside of the hollow body of the tool, during the woodgraining process.

According to a preferred feature of the present invention, the blank may contain a plurality of teeth disposed at one end of the tool. Thus, advantageously, in this embodiment both working surfaces needed to create the desired effect are provided in a single hand-held portable unit, which can be formed from an easily storable blank, and either end may be held, as appropriate, when the tool is used to create the grained appearance.

In one embodiment of the invention, the teeth may be on a separate attachment which can be secured to the tool. The teeth on the separate attachment may also function as the securing means of the tool which advantageously fits over the ends of the blank when wrapped around itself to form the tool. In another embodiment, the teeth may be on one or both ends of the blank which forms the tool. Where the teeth are on both ends of the blank, two sets of teeth may be provided which advantageously may be orientated in substantially opposite directions on the tool.

When the teeth have been used to produce a veined appearance on the surface, the ridges on the convex surface, when rocked about the convex surface, complete the continuous natural grained finish. Typically, the tips of the teeth comprise a contact edge in which one face is relatively more bevelled (a so-called "chisel" type tooth), or the two faces may be at substantially the same angle of inclination (a so-called spear-section). The respective inclined faces may typically extend for about 2 to 5 mm from each tip of the teeth.

In some embodiments, either side of the teeth can be used in either direction, eliminating confusion as to which side of the tool is to be used. Typically, the teeth and ridge formations are from 2 to 10 mm apart.

In a preferred embodiment, the teeth, the convex surface and the proud formations all together comprise a unitary integral molding.

In another embodiment, the proud formations may be on a separate molding attachment, releasably engageable with the blank which comprises the base of the tool. This would allow imitation woodgrains of different size and shape to be created by the same tool.

Typically, the securing means comprise complementary jointing formations such as a dovetail joint, or pop studs releasably engageable with reception apertures on the blank. In the latter case, further reception apertures may be provided in series along the length of the blank to receive such pop studs, serving to maintain the blank in its proper configuration. Alternate securing means comprise adhesive (for example double-sided adhesive tape). Thus, advantageously, the diameter of the convex surface of the tool may be varied, thus creating grains of different size and shape.

Connection means may also be provided to connect the molding attachment to the tool; the connection means may comprise pop studs releasably engageable with reception apertures of the type as described for maintaining the blank in the tool configuration.

The blank may be made of any suitably stiff material, but which is sufficiently flexible to allow the blank to be wrapped around, or doubled over on itself, without snapping. The material used for the blank may comprise a suitable plastics material, which is sufficiently flexible and lightweight, and thus easily portable. As mentioned above, the resulting hollow tool is preferably resilient.

In one embodiment of the invention, the blank is substantially flat, and may have a plurality of fold lines along its length such that when the blank is wrapped around itself along the fold lines it forms the tool. Alternatively, the blank may be stepped in cross section.

The present invention is particularly advantageous in providing a decorated article, and a method of producing the same, which are largely free of organic solvents (except possibly for small amounts of co-solvent). This aspect is environmentally beneficial, which is particularly advantageous when the resulting articles are found or used within building interiors.

There is further provided by the present invention an article having a decorative coating, and obtained according to a method substantially as hereinbefore described.

The method according to the present invention results in an article comprising:

(a) a substrate having an opaque surface;

(b) a decorative coating provided on said surface and comprising an intimate mixture comprising a particulate material and an aqueous film-forming polymer binder, said coating being lighter in color than said surface and being discontinuously provided thereon so as to expose part of said surface.

The nature of the substrate, opaque surface and decorative coating are substantially as hereinbefore described.

DETAILED DESCRIPTION OF PREFERRED EMBODIMENTS

Figure 1:
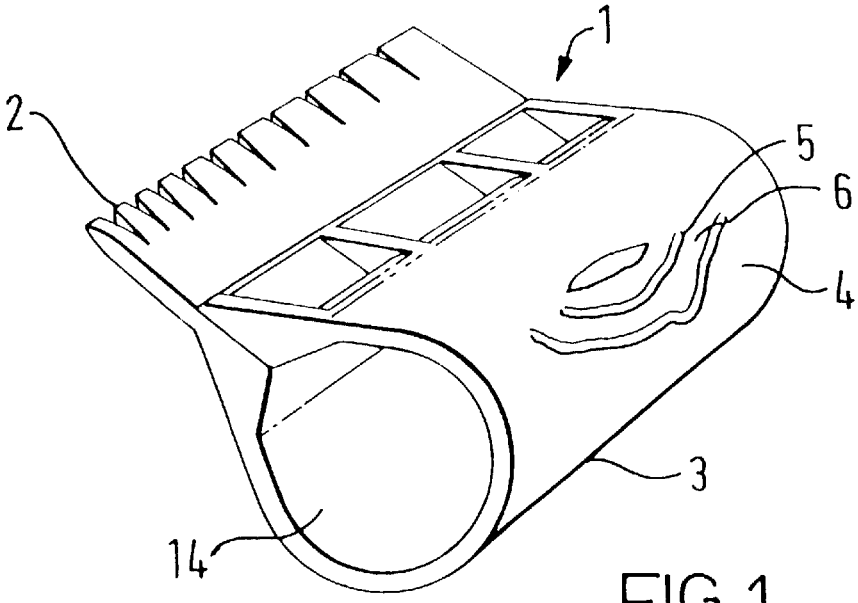
FIG. 1 is a perspective view of a tool made from a blank used in the method according to the invention.
Figure 2:
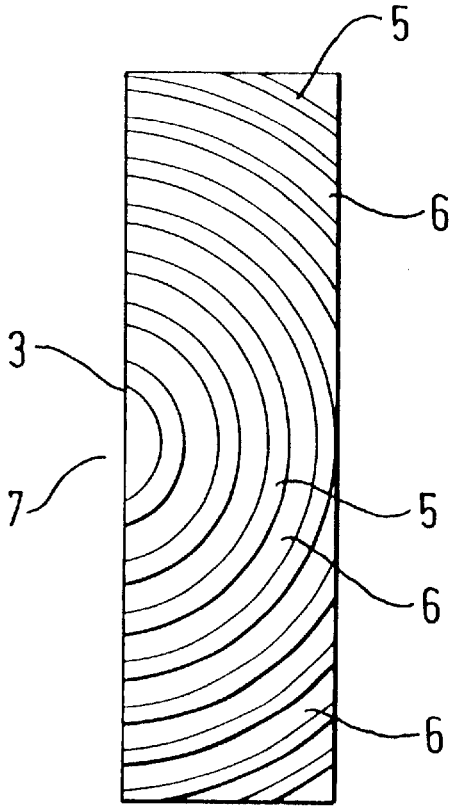
FIG. 2 is an elevational view of an alternate convex surface for the blank of FIG. 1.

Referring initially to FIG. 1, there is shown a graining tool for use by decorators, which tool is indicated generally by the reference numeral 1. The tool may comprise a plurality of teeth 2, and an arcuate convex surface 3, having a plurality of spaced ridge formations 4 which comprise a series of undulating ridges 5 and furrows 6. (An alternate arrangement with smooth ridges and furrows is illustrated in FIG. 2, in which the formations 4 are concentric about an intermediate point 7 of the convex surface 3 of the tool.) The tool 1 is substantially pear-shaped in cross-section. The end of the tool having the convex surface 3 is hollow.

Figure 3:
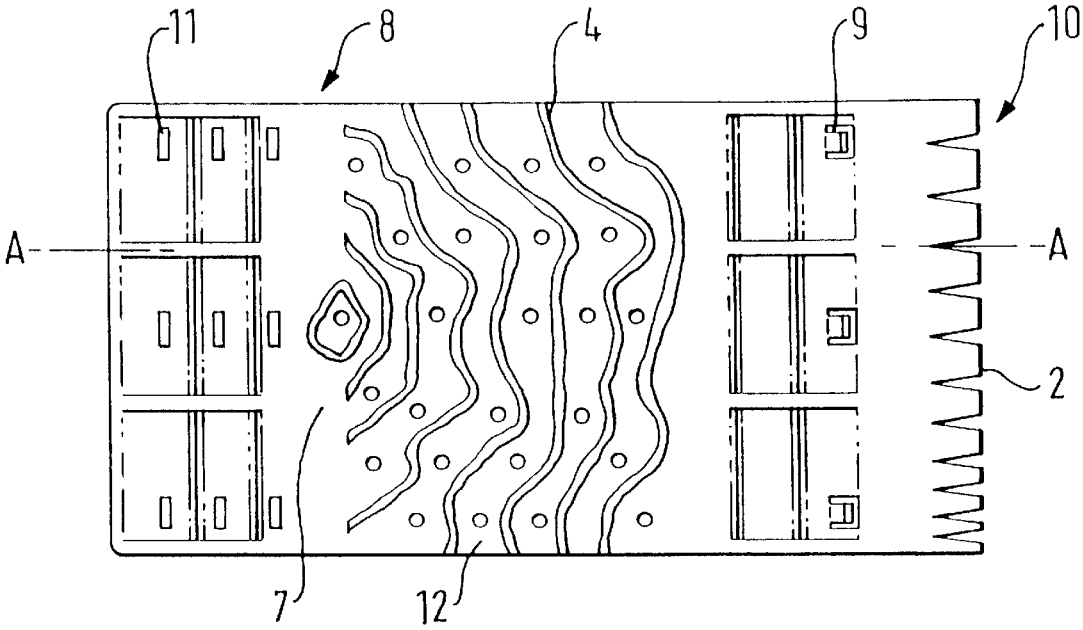
FIG. 3 is a plan view of a flat blank according to the invention.
Figure 4:
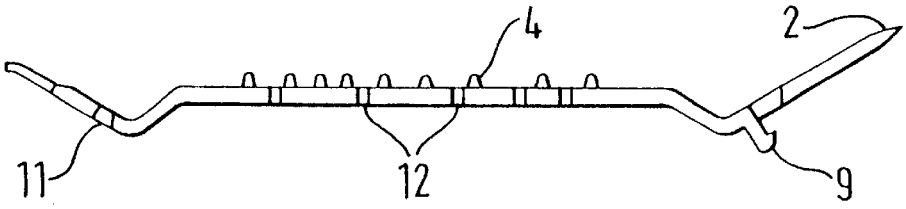
FIG. 4 is a section along the line A—A of FIG. 3.
Figure 5:
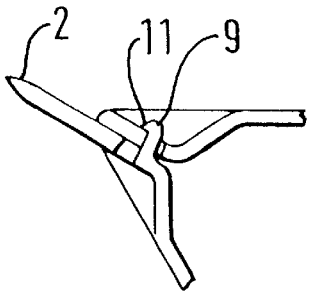
FIG. 5 is a detailed sectional view of the connected ends of the assembled tool of FIG. 1.

Referring to FIGS. 3 to 5, there is illustrated a blank 8, which forms the graining tool 1. The blank 8 is folded over and secured to itself such that the ridge formations 4 are on the outer convex surface of the tool 1. Studs 9 are provided on an end 10 of the blank 8, for engaging with reception apertures 11 on the opposite end of the blank 8. A further series of apertures 12 is interspaced between the furrows 6 of the outer convex surface of the tool 1, the apertures serving to alleviate build-up of excess graining material (not shown) during the graining process, the excess graining material passing through the apertures 12 into the space 14 (shown in FIG. 1) which is formed when the blank 8 is folded over upon itself to form the tool 1.

Figure 6:
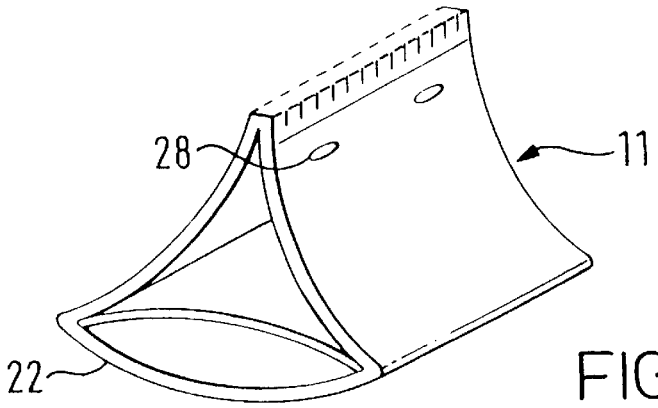
FIG. 6 is a perspective view of a further embodiment of tool formed from a blank used in the method according to the invention.
Figure 7:
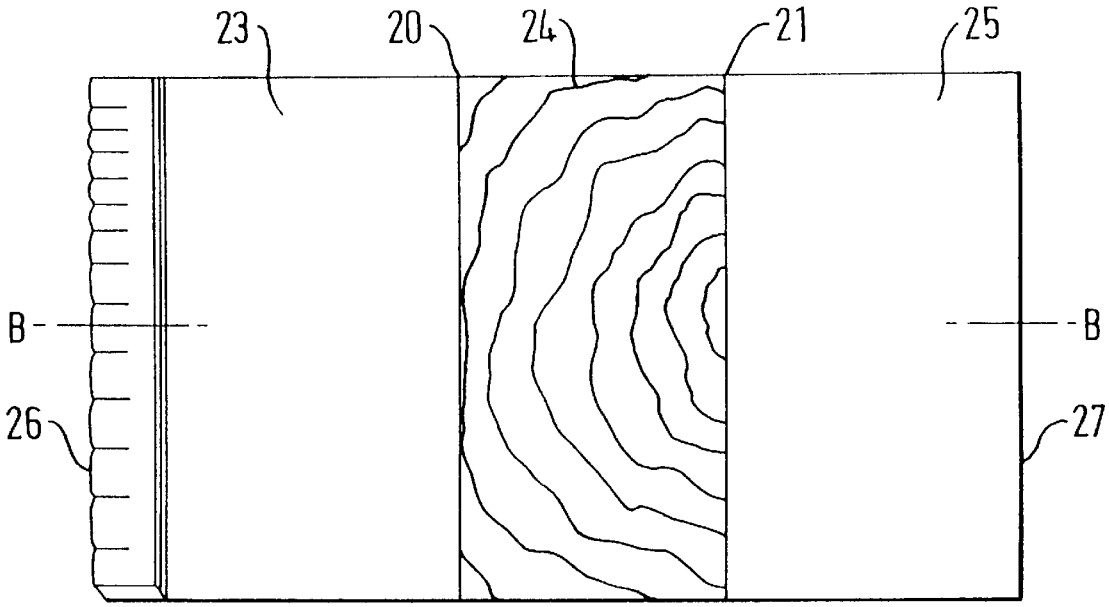
FIG. 7 is a plan view of a blank which forms the tool of FIG. 6.
Figure 8:
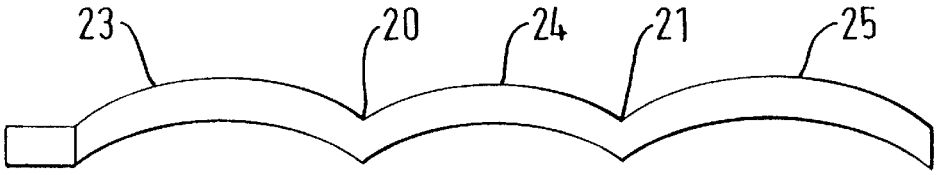
FIG. 8 is a section along the line B—B of FIG. 7.

Referring to FIGS. 6 to 8, and initially to FIG. 6, there is illustrated an alternate embodiment of a graining tool 11. The blank 8 which forms the tool (as shown in FIGS. 7 and 8) comprises fold lines 20 and 21 spaced along the length of the blank. Fold line 20 separates concave surfaces 23 and 24, and fold line 21 separates concave surfaces 24 and 25. When surfaces 23 and 25 are folded about their respective fold lines 20 and 21, the ends 26 and 27 are brought together to form the tool 11. When the tool 11 is formed, the concave surface 24 can be pushed outwardly to form the convex surface 22 of the tool 11. The ends 26 and 27 can be secured by pop studs (not shown) on one end of the tool engaging with complementary apertures on the other end in the same way as for the embodiment of FIG. 1 described above. Alternately, the ends can be secured by a separate attachment (not shown), which fits over the ends 26 and 27 of the tool. Such a separate attachment can provide teeth formations, if wished.

Figure 9:
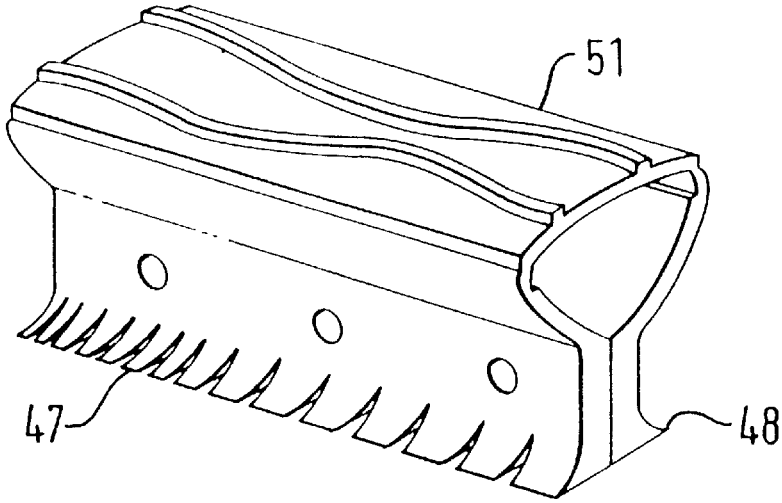
FIG. 9 is a perspective view of an alternative embodiment of tool formed from a blank according to the invention.
Figure 10:
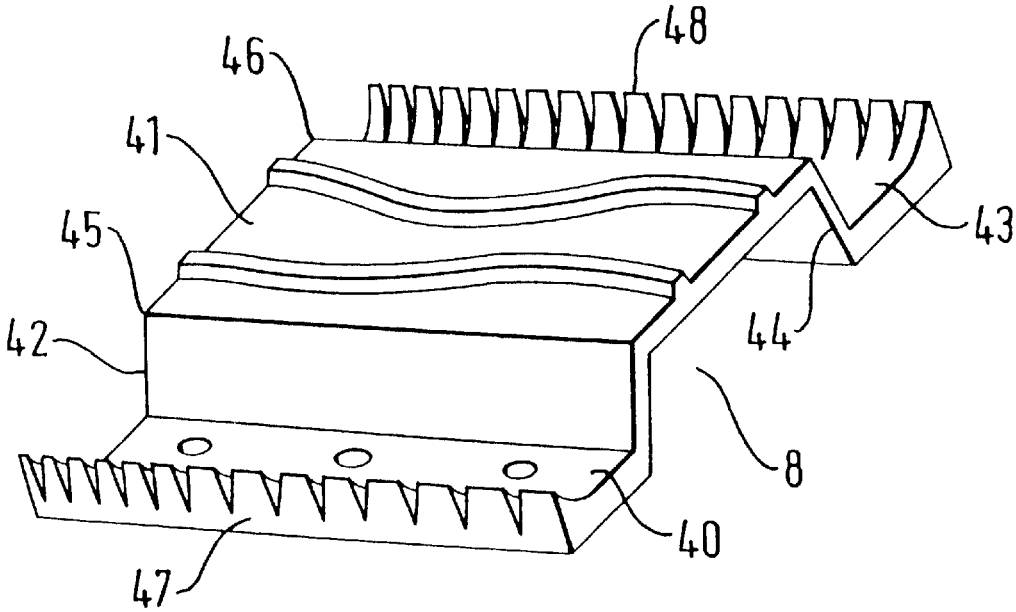
FIG. 10 is a perspective view of a blank which can form the tool shown in FIG. 9.
Figure 11:
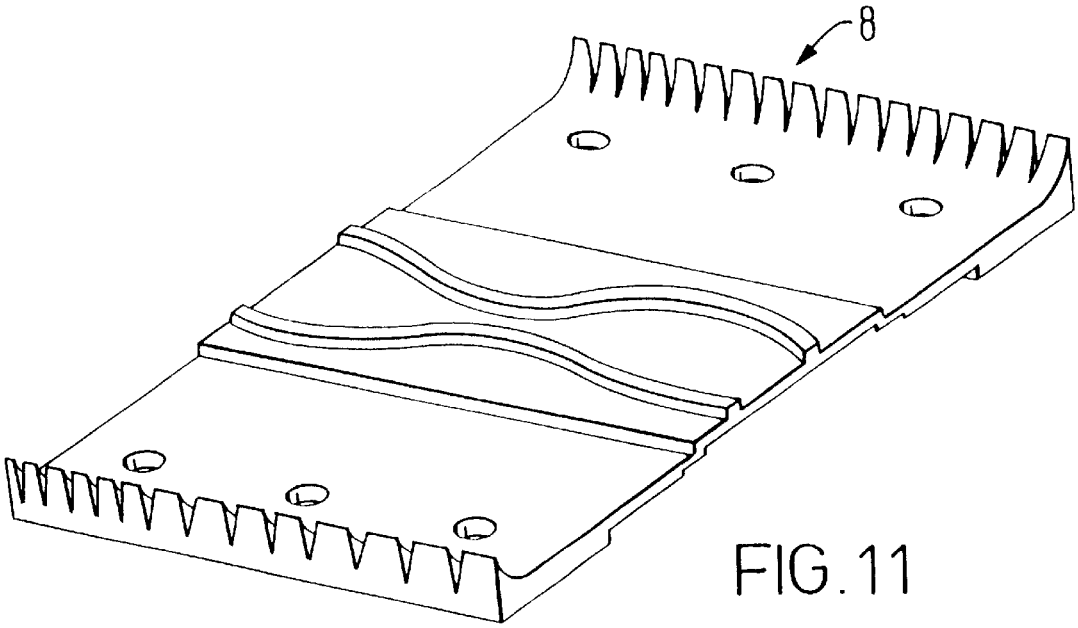
FIG. 11 is a perspective view of an alternate blank which can form the tool shown in FIG. 9.

Referring to FIGS. 9 to 11, there is illustrated a further embodiment of the graining tool 51. The blank 8 which forms the tool is shown in FIGS. 10 and 11. The blank 8 in FIG. 10 is stepped, having a surface 40 connected to a stepped surface 41 by a first intermediate web 42. The stepped surface 41 is connected to a further surface 43 by a second intermediate web member 44. Teeth formations 47 and 48 are oriented substantially upwardly with respect to the surfaces 40 and 43 respectively. The blank is folded about fold lines 45 and 46 on the stepped surface to form the tool 51, the teeth formations 47 and 48 being oriented on the tool 51 in substantially opposite directions. The surfaces 40 and 43 are secured to one another by complementary engaging formations, such as a dovetail joint (not shown) or alternately by adhesive tape or the like. The blank 8 shown in FIG. 11 forms the same tool 51 but is substantially flat in cross section.

Figure 12:
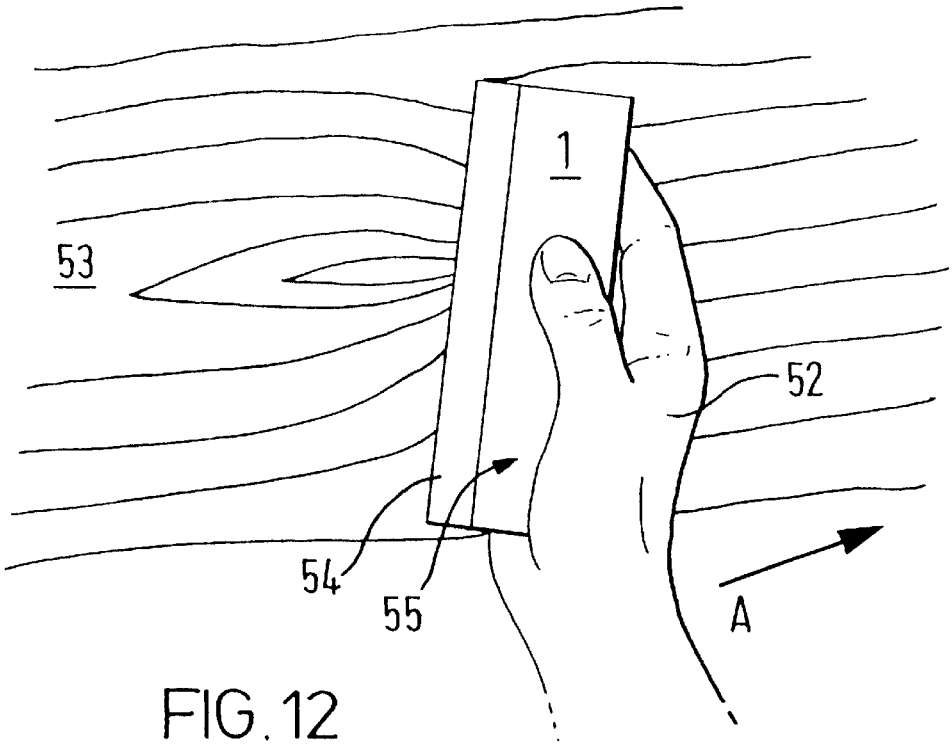
FIG. 12 is a schematic view, by way of example, of the second stage of removal of the continuous layer in the method according to the invention.

Referring to FIG. 12 there is shown a hand 52 holding a rockable tool 1 which can be drawn in the direction of arrow A across a surface 53 having thereon a streaked or veined coating previously applied. Tool 1 has an elongate edge strip 54 and an elongate grip strip 55.

Figure 13:
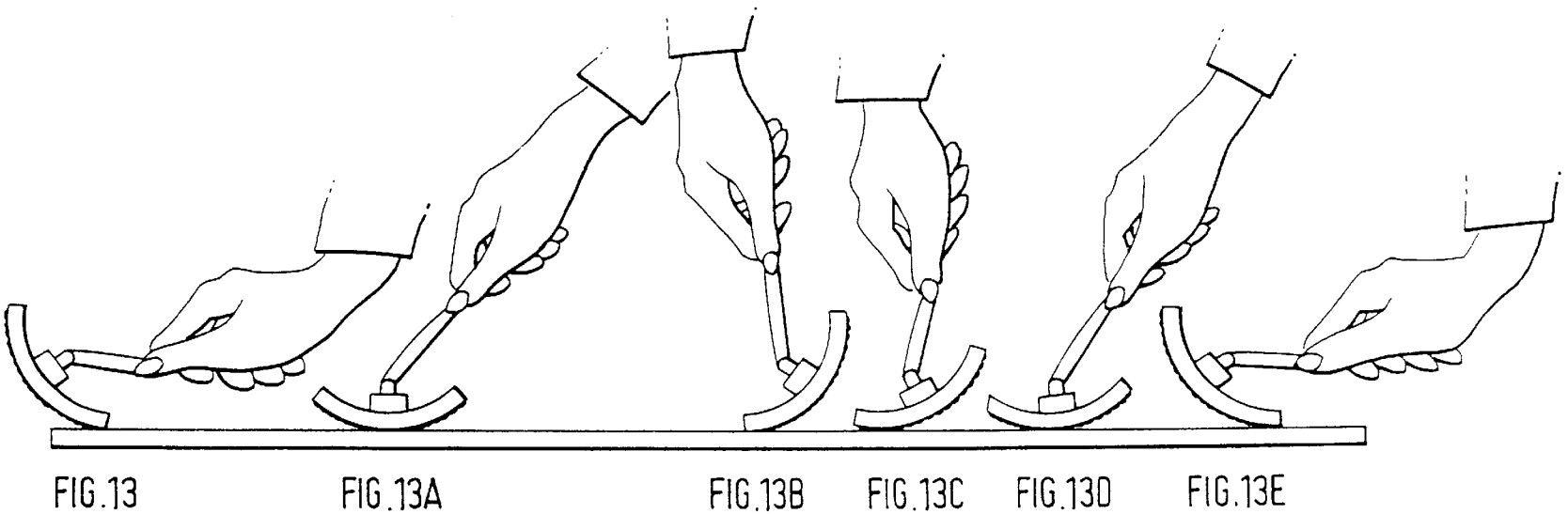
FIG. 13 is a schematic view illustrating the nature of a manual rocking action in the method according to the invention.

Referring to FIG. 13, there is shown a sequence of six successive operations, where, in FIG. 13(*a*), the user's wrist is cocked. In FIGS. 13(*b*), (*c*), (*d*) and (*e*), the user's wrist is substantially straight as the tool 1 is drawn across the surface; in FIG. 13(*f*), the user's wrist is cocked again to complete a single cycle of rocking the tool.

The present invention will now be further illustrated by the following example which does not limit the scope of the invention in any way.

A wood panel suitable for use as a building door was primed with white spirit based alkyd paint to receive a base coating of paint thereon. The paint for the base coating selected was light brown or beige (resembling the color of light or limed oak).

The base paint was brushed onto a major face of the panel so as to provide a complete coating thereon and allowed to dry for two hours.

An intimate mixture was prepared containing four parts plaster, four parts water, one part film-forming of an aqueous polyacrylate dispersion, one part of a cellulose based gel, and a small amount of an alcohol based co-solvent.

The intimate mixture was applied onto the based paint coating so as to form a continuous layer thereon. A comb was drawn across the continuous layer, along the length of the panel, so as to penetrate to the paint coating and to discontinuously remove the layer and expose the underlying paint, and thereby provide an irregular veined appearance resembling that of timber grain, with the grains extending in a longitudinal direction of the panel.

A rockable tool having a convex face with raised arc formations (as described above with reference to the drawings) was then drawn across the veined layer in the general direction of the previously provided veins; the convex face was drawn in the direction of travel of the rockable tool while at the same time slowly rocked, so as to produce a heart grain effect on the panel.

The decorative grained layer was then allowed to dry, and a finishing varnish applied thereover. The result was an aesthetically pleasing, resembling the appearance of limed oak.

What is claimed is:

1. A method for providing a substrate with a decorative coating simulating an appearance of grained wood, said method comprising the steps of:

(a) providing a flexible sheet blank having a first surface and a second surface, said first surface and said second surface being opposite surfaces to one another, opposite end portions and an intermediate portion, and a plurality of spaced-apart ridges provided on said first surface in said intermediate portion;

(b) forming a tool by wrapping said flexible sheet blank around into a rolled configuration so that said first surface of said flexible sheet blank faces outwardly and said opposite end portions of said flexible sheet blank are disposed and held together with corresponding portions of said second surface in face-to-face contact, said tool being a hollow body and said second surface of said intermediate portion forming a convex face of said tool body and said opposite end portions forming a grip;

(c) applying, to an opaque surface of a substrate, a substantially continuous layer having a medium comprising a liquid containing a polymeric binder and a particulate material;

(d) drawing said tool along said opaque surface of said substrate, while said substantially continuous layer remains in a liquid state; and, (e) rocking said tool about said convex face as said tool is drawn along said opaque surface of said substrate, so as to discontinuously remove parts of said substantially continuous layer for selectively exposing part of said opaque surface for producing a decorative appearance simulating that of grained wood.

2. The method for providing a substrate with a decorative coating simulating an appearance of grained wood according to claim 1, wherein said tool is formed from said flexible sheet blank by wrapping said flexible sheet blank around and securing said opposite end portions of said flexible sheet blank to each other via securing means for forming said hollow body at one end of said tool.

3. The method for providing a substrate with a decorative coating simulating an appearance of grained wood according to claim 1, wherein said intermediate portion is inwardly deformable under manual pressure when said tool is being used for providing said substrate with a decorative coating.

4. The method for providing a substrate with a decorative coating simulating an appearance of grained wood according to claim 1, wherein said plurality of spaced-apart ridges includes a series of substantially concentric formations.

* * * * *